US006420829B1

(12) United States Patent
Diepers

(10) Patent No.: US 6,420,829 B1
(45) Date of Patent: Jul. 16, 2002

(54) INPUT WINDOW OF A RAIDOGRAPHIC IMAGE INTENSIFIER AND METHOD FOR MAKING SAME

(75) Inventor: Heinrich Diepers, Hoechstadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/392,737

(22) Filed: Sep. 9, 1999

(30) Foreign Application Priority Data

Sep. 11, 1998 (DE) ..... 198 41 772

(51) Int. Cl.[7] ..... H01J 29/36; H01J 9/20
(52) U.S. Cl. ..... 313/543; 313/530; 313/541
(58) Field of Search ..... 313/530–539, 313/541, 542, 543, 365, 384

(56) References Cited

U.S. PATENT DOCUMENTS

| | | | |
|---|---|---|---|
| 3,353,983 | A | 11/1967 | Guyot |
| 3,852,632 | A | 12/1974 | Franz et al. |
| 4,195,230 | A | 3/1980 | Ataka et al. |
| 5,128,719 | A | 7/1992 | Umeda et al. |
| 5,905,014 | A | 5/1999 | Van de Bergh |

FOREIGN PATENT DOCUMENTS

| | | |
|---|---|---|
| DE | OS 24 22 354 | 11/1975 |
| DE | PS 43 42 219 | 2/1996 |
| GB | 2 231 684 | 11/1990 |
| JP | 5616251 | 12/1981 |

*Primary Examiner*—Ashok Patel
(74) *Attorney, Agent, or Firm*—Schiff Hardin & Waite

(57) ABSTRACT

In a radiographic image intensifier having an input window, and a method for its production, an intermediate layer is deposited on a substrate for a luminous layer, thereby smoothing the surface of the substrate. This intermediate layer serves to smooth the surface of the substrate and is thus a good base for a uniform growth of the crystal structure of the luminous layer.

2 Claims, 1 Drawing Sheet

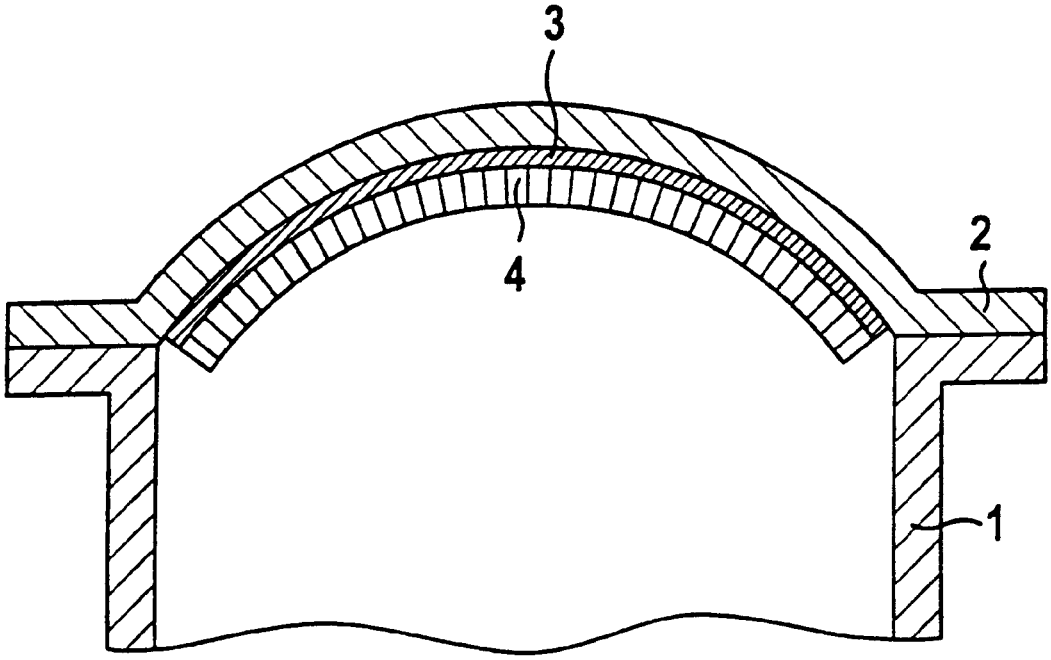
3
4
2
1

INPUT WINDOW OF A RAIDOGRAPHIC IMAGE INTENSIFIER AND METHOD FOR MAKING SAME

BACKGROUND OF THE INVENTION

1. Field of the Invention

The present invention is directed to an input window for a radiographic image intensifier as well as to a method for making such an input window.

2. Description of the Prior Art

German PS 43 42 219 discloses a radiographic image intensifier with an input window wherein a layer of luminous material is deposited on a carrier, this layer converting the incident x-rays into light. A photocathode is usually vacuum evaporated (metallized) on the layer of luminous material, this photocathode converting the light that emanates from the layer of luminous material into electrons. The electrons are opto-electronically projected onto the output window, which is situated opposite the input window. The output window is formed as an output luminescent screen by means of which the energy of the electrons is converted into light, which is detected by a downstream camera, for example, and this light is displayed at a display apparatus via an image intensifier video chain as an image of a transirradiated subject. As a substrate, the aforementioned carrier consists of an aluminum sheet to which a collar form is imparted by rolling, deep-drawing or roll-pressing. In known fashion, the inner concave surface of the collar-shaped substrate must be optimally smooth and/or structurally homogenous, so that in the evaporation of a luminous layer consisting of cesium iodide, for example, the cesium iodide grows uniformly in the column structure.

SUMMARY OF THE INVENTION

It is an object of the present invention to provide an input window for a radiographic image intensifier and a method for making it wherein the substrate has a smooth and structurally homogenous surface on which the uniform growth of the crystal structure is possible.

This object is achieved in accordance with the principles of the present invention in an image intensifier having an input window and a method for making same wherein an intermediate layer is deposited on a substrate for a luminous layer, smoothing the surface of the substrate. The surface flaws and damaged locations, as well as unevenness and fissures, holes and depressions which are brought about in the rolling, deep-drawing or roll-pressing, are compensated by the intermediate layer, so that there is a good base for the growth of the crystal structure of the luminous substance on the intermediate layer.

DESCRIPTION OF THE DRAWINGS

The single FIGURE is a sectional view of a radiographic image intensifier constructed and manufactured in accordance with the principles of the present invention.

DESCRIPTION OF THE PREFERRED EMBODIMENTS

The figure illustrates a cross-section of a portion of a radiographic image intensifier, having a vacuum vessel 1. A substrate 2 of an input window of the radiographic image intensifier is in vacuum-tight contact with the vacuum vessel 1. The substrate 2, which is fashioned into a collar shape by means of rolling, deep-drawing, or roll-pressing, inventively has an intermediate layer 3 on its inner, concave surface, on which layer a luminous layer 4 is deposited, which converts incident radiation, such as X-rays, into light. On the side of the vacuum vessel I situated opposite the substrate 2 there is the output window (not illustrated).

The intermediate layer 3 is deposited on the substrate 2 in a fluid or highly viscous state, for instance as a slip, suspension, or solution, by a deposition method such as spraying, spinning on, or immersion, and it has a surface tension such that a smooth surface arises after drying. If the intermediate layer 3 is aluminum enamel, then it is dried subsequent to deposition on the substrate 2 and subsequently undergoes a tiring process. The intermediate layer 3 can also comprise a polyimide, which is produced in an imidization process subsequent to the deposition of the starting substance, e.g. in the form of the allotherm 610 polyamidocarboxylic acid (commercially available from: BASF), and to drying at 70–100° C. The intermediate layer 3 is preferably optically opaque, so that it does not let light that is reflected at the substrate surface pass through to the luminous layer 4, or does so only slightly. Light deflected at the substrate 2 could unintentionally generate photoelectrons on the photocathode (not illustrated) adjacent the luminous layer 4, which would degrade the imaging characteristics. An imaging onto the output luminescent screen, via the light that is reflected at the surface of the input window and scattered, by defects, surface damage, and unevenness; particularly of the substrate 2 is prevented. Such scattering may appear on the display apparatus via the image intensifier video chain and could lead to misinterpretations of an X-ray image.

The opaque appearance of the polyimide intermediate layer can be achieved by mixing $TiO_2$ powder, preferably having a submicrometer grain.

Besides the possible materials already mentioned for the intermediate layer 3, other suitable materials can be used which have a surface tension for generating a smooth surface and which are vacuum stable, which means that residuals of the solvents, for example, cannot evaporate into the vacuum-vessel of the image intensifier.

The substrate 2 preferably consists of aluminum or of an aluminum alloy in a thickness of approximately 1 mm. Preferably, alloys of the formula $AlMg_x$ (x=1-3) or $AlMgSi_x$ (x=0,5-2) are used, which have a sufficient stability for withstanding the vacuum pressure given a wall thickness of less than 1 mm and have a homogenous distribution of alloy components. Under these conditions, other alloy compositions can be determined by those skilled in the art.

In the context of the invention, it is particularly preferable for a layer of pure (99.5% Al) or ultrapure (Al>99.5%) aluminum to be deposited on the substrate 2, for instance by rolling, on which layer the smoothing layer of enamel or polyimide is then deposited. The pure Al layer thickness can be in the range from 20 $\mu$m to 80 $\mu$m, preferably in the region of 50 $\mu$m; however, care must be taken that the total layer density of the substrate 2 remains in the range <1 mm, in order to keep the X-ray absorption optimally low, but the mechanical stability must be sufficiently high so that the substrate 2 can withstand the pressure load. Due to the use of the pure aluminum layer, disturbances due to alloy components such as Mg no longer appear. Because of this construction, an input window of an X-ray image intensifier is thus obtained wherein the aluminum substrate 2 guarantees the resistance to pressure, and the pure aluminum layer, which is preferably deposited on the substrate 2 as sheet metal by rolling, guarantees an improved base for a good enameling for a smoother surface with few local flaws.

Although modifications and changes may be suggested by those skilled in the art, it is the intention of the inventor to embody within the patent warranted hereon all changes and modifications as reasonably and properly come within the scope of his contribution to the art.

I claim as my invention:

1. An input window of a radiographic image intensifier comprising:

a substrate having a substrate surface;

an optically opaque intermediate layer deposited on said substrate surface to smooth said substrate surface, said intermediate layer comprising material selected from the group consisting of aluminum enamel and a polyimide; and a luminous layer applied on said intermediate layer on said substrate surface.

2. An input window as claimed in claim 1 wherein said substrate has a collar-like shape.

* * * * *